United States Patent [19]

Hills et al.

[11] 4,035,880

[45] July 19, 1977

[54] APPARATUS FOR DRAWING AND CRIMPING YARN

[75] Inventors: William H. Hills, Melbourne; Milton H. Borgman, West Eaugallie, both of Fla.

[73] Assignee: Carisbrook Industries Inc., Iselin, N.J.

[21] Appl. No.: 619,231

[22] Filed: Oct. 3, 1975

[51] Int. Cl.[2] ..... D02G 1/12; D02J 1/22

[52] U.S. Cl. ..... 28/220; 28/241; 28/244; 28/248

[58] Field of Search ..... 28/1.6, 1.7, 1.3, 72.14, 28/71.3, 220, 258, 243, 244, 241, 268; 264/290 R; 29/121

[56] References Cited

U.S. PATENT DOCUMENTS

| | | | |
|---|---|---|---|
| 3,614,818 | 10/1971 | Satterwhite | 28/1.6 |
| 3,781,952 | 1/1974 | Stanley | 28/1.6 |
| 3,949,041 | 4/1976 | Schwarz | 28/71.3 X |

*Primary Examiner*—Louis K. Rimrodt
*Attorney, Agent, or Firm*—Schuyler, Birch, Swindler, McKie & Beckett

[57] ABSTRACT

In combination, a drawing apparatus and a crimping apparatus. The drawing apparatus comprises integral first and second draw rolls, with attendant separator rolls, and a draw pin. The final draw roll is fluted around its peripheral surface. The draw rolls are driven from the same source as the crimp feed rolls, and in order to control yarn tension at the crimp feed rolls a variable drive means is provided for the draw rolls, to alter their speed with regard to the speed of the feed rolls. A yarn heater is positioned between the final draw roll and the crimp feed rolls, or in the alternative, between the final draw roll and its separator roll.

5 Claims, 4 Drawing Figures

APPARATUS FOR DRAWING AND CRIMPING YARN

BACKGROUND OF THE INVENTION

The prior art suffers from no shortage of methods and apparatus for the drawing and crimping of yarn. However, these prior art systems have suffered from a number of problems, not the least of which is that of properly and accurately drawing synthetic yarn, such as polyester yarn, at high pass-through rates. A new generation of crimping devices is capable of crimping yarn at rates of one thousand meters per minute. The prior art draw techniques and apparatus can not match that rate, while accurately drawing the yarn and feeding it to the crimper under controlled conditions. This has resulted in slower operating speeds for the stuffer-crimper equipment, with the practical result of diminishing its value in the marketplace, as compared with other systems for texturing yarn.

SUMMARY OF THE INVENTION

This invention has as its overall object the solving of the problems present in this type of equipment in the prior art.

A more specific object of the invention is to provide a drawing and crimping method and apparatus that is capable of operating at high rates while maintaining precise control over such variables as degree of draw, yarn temperature and yarn tension.

Another specific object of this invention is to provide a new and improved draw roll.

Still another specific object of this invention is to provide a simplified control over yarn tension at the entrance to the crimper.

Still another object of this invention is to provide a compact drawing apparatus that can easily be attached to and integrated in operation with existing stuffer crimper equipment.

These and other objects will become more apparent from a reading of the following description of the invention and of several preferred embodiments thereof.

Partially Oriented Yarn (POY) or unoriented yarn is supplied to the drawing mechanism, and then to the crimping mechanism. The various reasons for drawing prior to crimping are well known in the art, as are the internal changes to the yarn caused by drawing. Suffice it to say that tension and temperature must accurately be controlled during the drawing operation. Additionally, it has been found that the crimping process is enhanced if the tension of the yarn is accurately controlled immediately prior to its entry into the crimper. Temperatures in the crimping chamber must accurately be controlled. The accuracy of temperature control of the yarn immediately prior to entrance into the crimper is also very important because the temperature of the yarn determines its plasticity and is a major factor in determining the size and shape of the crimps that are formed.

The method of this invention includes several basic concepts. First, the feed rolls of the stuffer crimper are operated at a constant rate. Control of yarn tension immediately upstream of the feed rolls is accomplished without changing the feed roll speed, by altering the speed of the draw rolls. The yarn is heated during the drawing process at the draw pin, to conrol the moment at which the yarn is drawn, and also at another point, downstream of the final draw roll, to supply heated yarn to the crimp feed rolls. The final draw roll is of material having poor heat conductivity characteristics, so that the minimum amount of heat is lost from the yarn during contact therewith. This is especially advantageous during start-up.

The inventive apparatus comprises integral first and second (final) draw rolls, rotating together at the same radial speed. The second or final draw roll many have a fluted peripheral surface, and is advantageously of material of low heat conductivity, or is coated with same, such as a ceramic. A first separator roll is used in conjunction with the first draw roll and a second with the second draw roll. A non-rotating circular heated draw pin is utilized. A plate heater is installed in one of two places. It can be completely separate from the drawing apparatus, or it can be integrated into the drawing apparatus, positioned between the second draw roll and its separator pin. The latter arrangement is more compact, and it is with this arrangement that the fluted draw roll is used to best advantage. The compact design also eliminates the need for one temperature sensor, which saves on complexity and cost.

The single compound draw roll is driven from the same source of rotative energy as the crimper feed rolls. A variable speed drive attachment connects the two. Yarn tension is sensed in advance of the crimper feed rolls, and the speed of the draw roll is adjusted to maintain the proper tension, either manually or automatically.

DESCRIPTION OF THE PREFERRED EMBODIMENT

Figure 1:
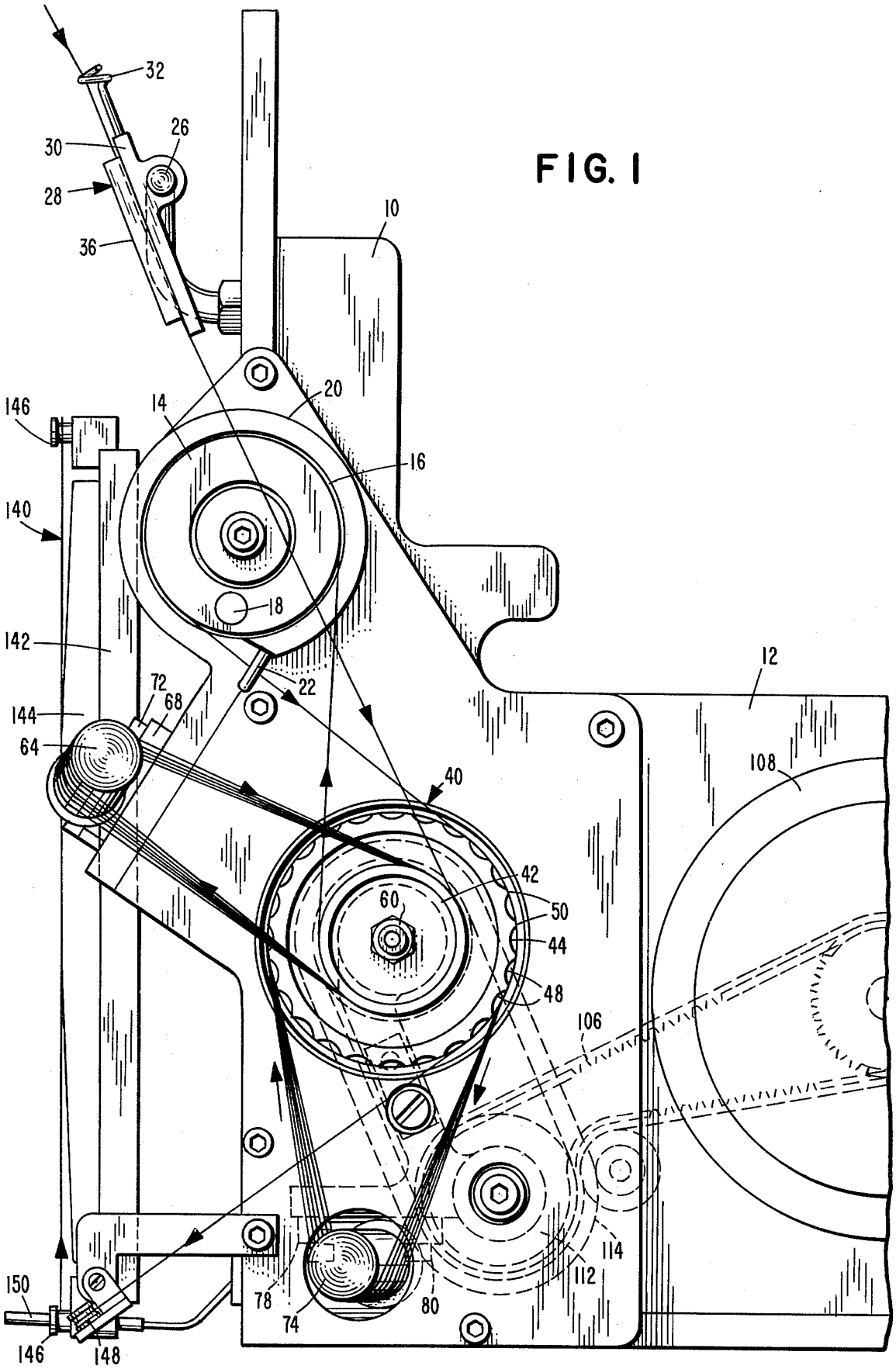
FIG. 1 is an elevational view of a first embodiment of the invention, showing the front of the draw mechanism and the side of the yarn preheater.

Looking to FIG. 1, the yarn draw mechanism comprises a frame 10 which is mounted on the machine frame 12. At the upper portion of frame 10 is a draw pin 14, of circular configuration. Draw pin 14 is non-rotating, and has a peripheral surface 16 over which the yarn passes. Suitable coatings can be used on surface 16. A heater 18 is installed within draw pin 14, to heat it to a predetermined temperature. A raised flange 20 surrounds the upper portion of the draw pin. A yarn guide pin 22 is mounted on shroud 20, to insure that the yarn does not slip off the draw pin. Suspended above draw pin 14 on an arm 26 is a tension gate 28, comprising a frame 30, to which is attached a yarn guide eye 32 and a pair of opposed plates 32, 34 which define between them a sinuous channel 38 through which the yarn is pulled.

Rotatably mounted on frame 10 is a drawing roll assembly 40, which comprises a first draw roll 42 and a second draw roll 44, which rotate together. First draw roll 42 has a smooth surface finish, which can be treated or impregnated with various substances to provide particular surface characteristics.

Second draw roll 44 is provided with a plurality of flutes 48 around the entire peripheral surface. Flutes 48 are spaced apart by yarn contact surface portions 50, upon which the yarn is wound. A key purpose of flutes 48 is to diminish the surface area contacting the yarn. It also provides a larger total surface area for the roll as well as creating pockets within which air can move. These features serve to lessen the heat transferred from the yarn to the roll because the yarn contacts less surface area of the roll, as well as allowing the roll to run much cooler than those of the prior art. This means that the roll reaches its stabilized or operating temperature much sooner than in prior art devices. Also in furtherance of this objective, second draw roll 44 is made of material having a low coefficient of heat conductivity, and its surface is coated or impregnated with an insulative material such as a ceramic. The minimizing of heat transfer from yarn to second draw roll is particularly advantageous during start-up operations, when the yarn has been heated to its desired temperature, but the second draw roll has not yet done so. Excessive heating of the second draw roll would tend to alter yarn projectures from start-up until the second draw roll reached an equilibrum condition. This occurs during the first 20 minutes or so of operations. The yarn must enter the crimping chamber at a particular temperature. It is heated at the draw pin and again prior to such entry. Any heat lost to the second draw roll must later be replaced.

The above factors also serve to reduce the time necessary for the system to reach and maintain equilibrium conditions. That is, the operating speeds and temperature. The interior of second draw roll 44 is provided with open areas or chambers 53 to reduce the mass of roller 44. In like manner, first draw roll 42 is hollow, to reduce the mass.

Second draw roll 44 is mounted on a shaft 54, which extends through a housing 56. Shaft 54 is supported for rotation by bearings 58. Second draw roll 44 rotates with shaft 54, and is attached thereto by a key 56. First draw roll 42 is attached to shaft 54 by means of a bolt 60, the tightening of which presses rolls 42 and 44 together.

A first separator roller 64 is spaced from first draw roll 42. First separator roll 64 is rotatably mounted upon a shaft 66, which is clamped to frame 10 by means of member 68, and bolts 72. The axis of first separator roll 64 is tilted with respect to the axis of the draw rolls, to space the wraps of yarn apart. A second separator roll 74 is rotatably mounted on shaft 76, which is held by a member 78 attached to frame 10 by bolts 80. The axis of second separator roll 74 is also tilted with respect to that of the draw rolls.

The draw roll drive mechanism is as follows: A driven wheel 90, a generally cylindrical shape but having a slight inclination of its peripheral surface, is keyed to a bolt 92, which in turn is attached to the free end of shaft 54. A drive shaft 94 is supported in housings 96 and 56 by a bearing ring 100. At one end of drive shaft 94 is a drive sprocket 104, around which passes a drive belt 106. Belt 106 is driven by an electric motor 108. A drive wheel 112, also of generally cylindrical shape but having slight inclination of the peripheral surface, is attached to and rotatable with drive shaft 94. The inclination of the outer surfaces of drive wheel 112 is opposite that of drive wheel 90. A drive belt 114 passes around the two drive wheels and is movable axially of the two drive wheels. A shaft 118 is supported in cantilever fashion by housing 56. A fork 120, having upstanding fingers 122 for engaging belt 114, is slidably mounted on shaft 118. A rotatable screw shaft 126 mounted in housing 56 has a threaded portion 128 and a slotted head portion 130. Threaded portion 128 meshes with a threaded opening in fork 120, so that rotation of screw shaft 126 results in lateral movement of fork 120 and, by means of contact between belt 114 and fingers 122, lateral movement of belt 114. Owing to the tapers of wheels 112 and 114, such lateral movement of belt 114 results in a change of rotational speed of driven shaft 54 with regard to driving shaft 94. The effect of this on the drawing of the yarn, and the yarn tension at the entrance to the crimp feed rolls, will be explained below.

Figure 2:
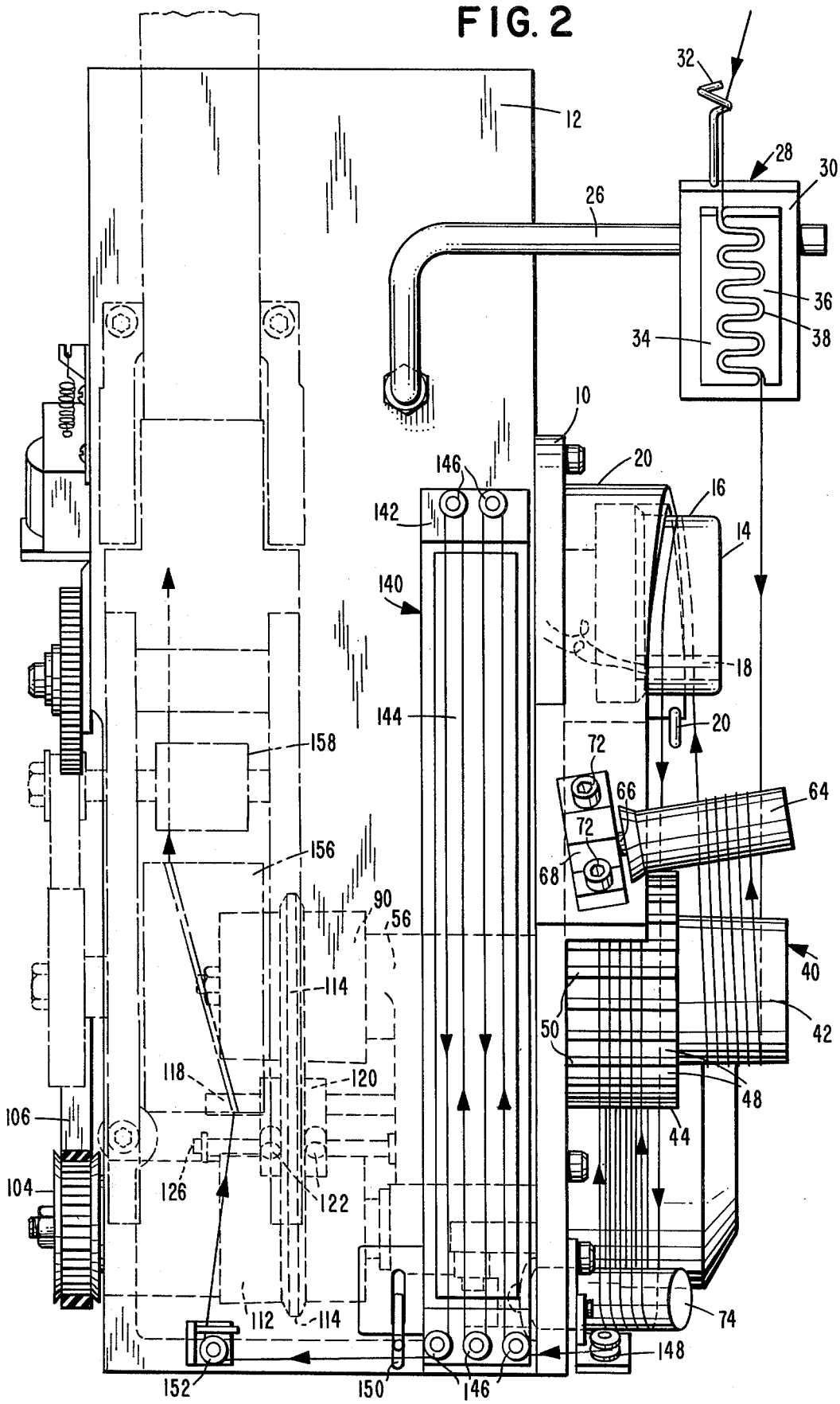
FIG. 2 is an elevational view of the first embodiment of the invention, showing the front of the crimper and the yarn preheater, and the side of the draw mechanism, partially in section.
Figure 3:
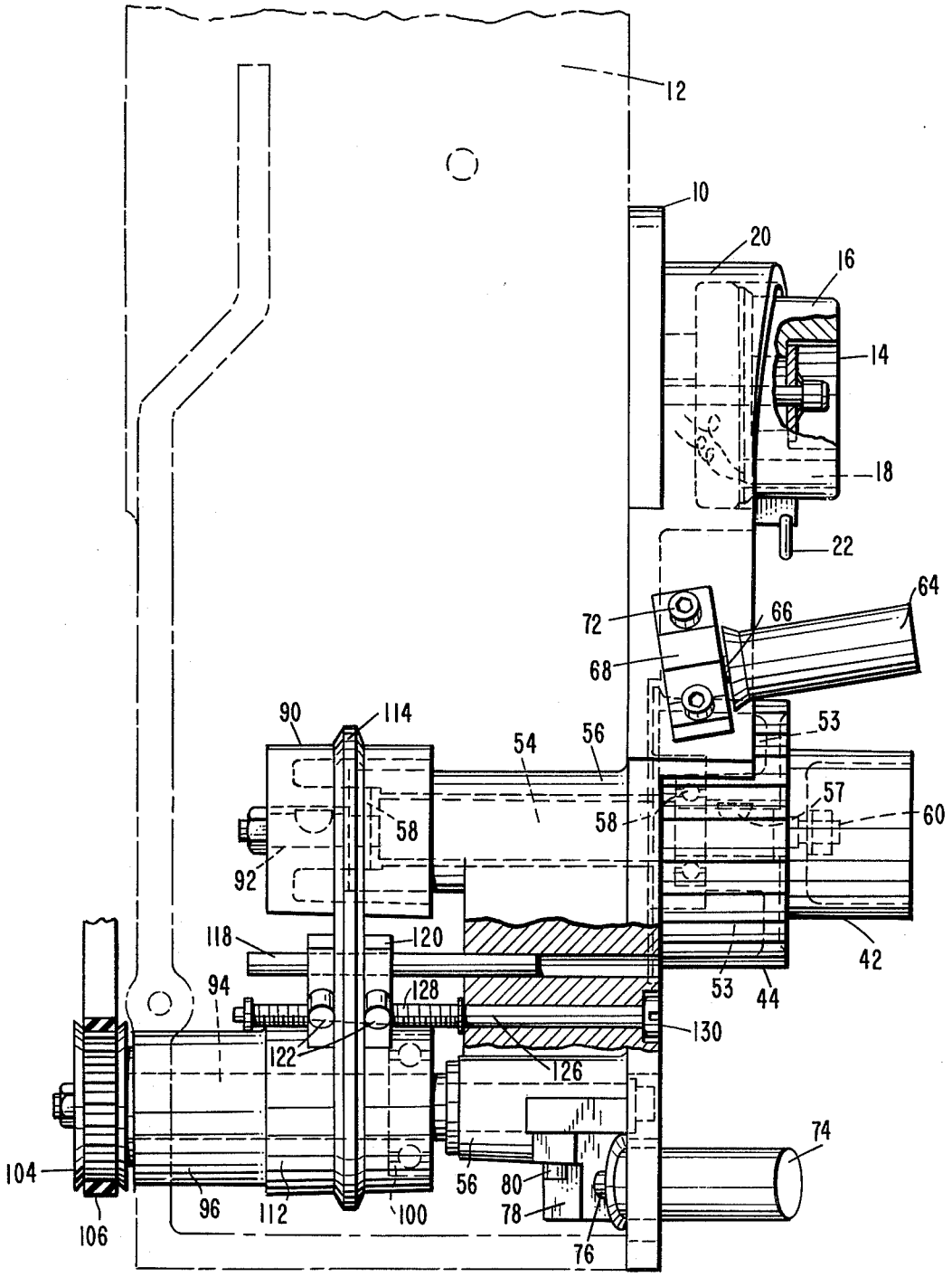
FIG. 3 is a side view, partially in section, of the draw mechanism variable speed drive means.

It is often times necessary to preheat the yarn after drawing, prior to its entry into the crimping chamber. One form of preheater is shown in FIG. 2, designated generally by the numeral 140. A preheater frame 142 is attached to the crimper machine frame. Centrally mounted on frame 142 is a heater block 144, which is energized to a desired temperature level. Five pins or grooved wheels 146 are positioned at opposite ends of heater block 144, for the yarn to be passed around so it describes four passes over the face of the heater block. Since heater 140 is at right angles to the drawing mechanism, the yarn must change direction to pass over heater 140, and therefore a grooved wheel 148 is provided, around which the yarn is passed to change its direction.

Immediately downstream of heater 140 is a yarn break sensing finger 150, which is biased against the yarn, and which operates electrical switches (not shown) to stop various components of the machine if the yarn breaks. Another grooved wheel 152 is provided to orient the yarn for the crimp traverse wheel 156, from whence it proceeds to the crimper feed rolls 158. An automatic tension sensing device, not shown, can be placed next to the break sensing finger 150, and used to control the draw roll drive speed regulation mechanism. This is an alternative arrangement.

The operation of the first embodiment of the invention is as follows: Incoming yarn, which can be partially oriented yarn, passes first through tensioning device 28 and then to first draw roll 42. The yarn is wrapped several times around first draw roll 42 and first separator roll 64, and then passes once around draw pin 14. Then, the yarn is wrapped several times around second draw roll 44 and second separator roll 74. The yarn is heated at the draw pin, and is drawn as it passes around of the draw pin. The extent of draw is determined by the difference in peripheral velocities of the two draw rolls, which are rotating at the same rate. Next, the drawn yarn proceeds to heater 140, where it is heated to or near the temperature required in the crimping chamber. Placement of the heater adjacent to the crimper minimizes the heat loss from the yarn between the heater and the crimper.

The tension on the yarn at the point of entry into the stuffer crimper is of great importance. Incorrect tension, or varying tension, can have a detrimental effect upon the crimping operation itself and upon the physical characteristics of the crimped yarn. It has been found that crimping at high speeds is best accomplished when the crimper feed rolls are operated at a constant rate. The yarn tension at the entry to the feed rolls is primarily a function of feed roll linear speed, draw roll linear speed, and inherent shrinkage of the yarn when the draw tension is relaxed. Typically, for example, for 150 denier yarn, draw tension is of the magnitude of 150 grams and entry tension at the feed rolls is about 15 grams. Tension control in this machine is effected by varying the speed of the second draw roll, as necessary. Since the feed rolls and draw rolls are driven from a common source, the varying of the draw roll speed must be accomplished by an adjustable draw roll drive mechanism, which is accomplished by moving belt 114 axially along wheels 90 and 112. Since both draw rolls rotate at the same rate, the speed of both is varied, but the degree of draw is not. Yarn tension is sensed, manually or automatically, and adjustment is made of belt 114 to increase or decrease draw roll speed to arrive at the desired yarn tension.

Figure 4:
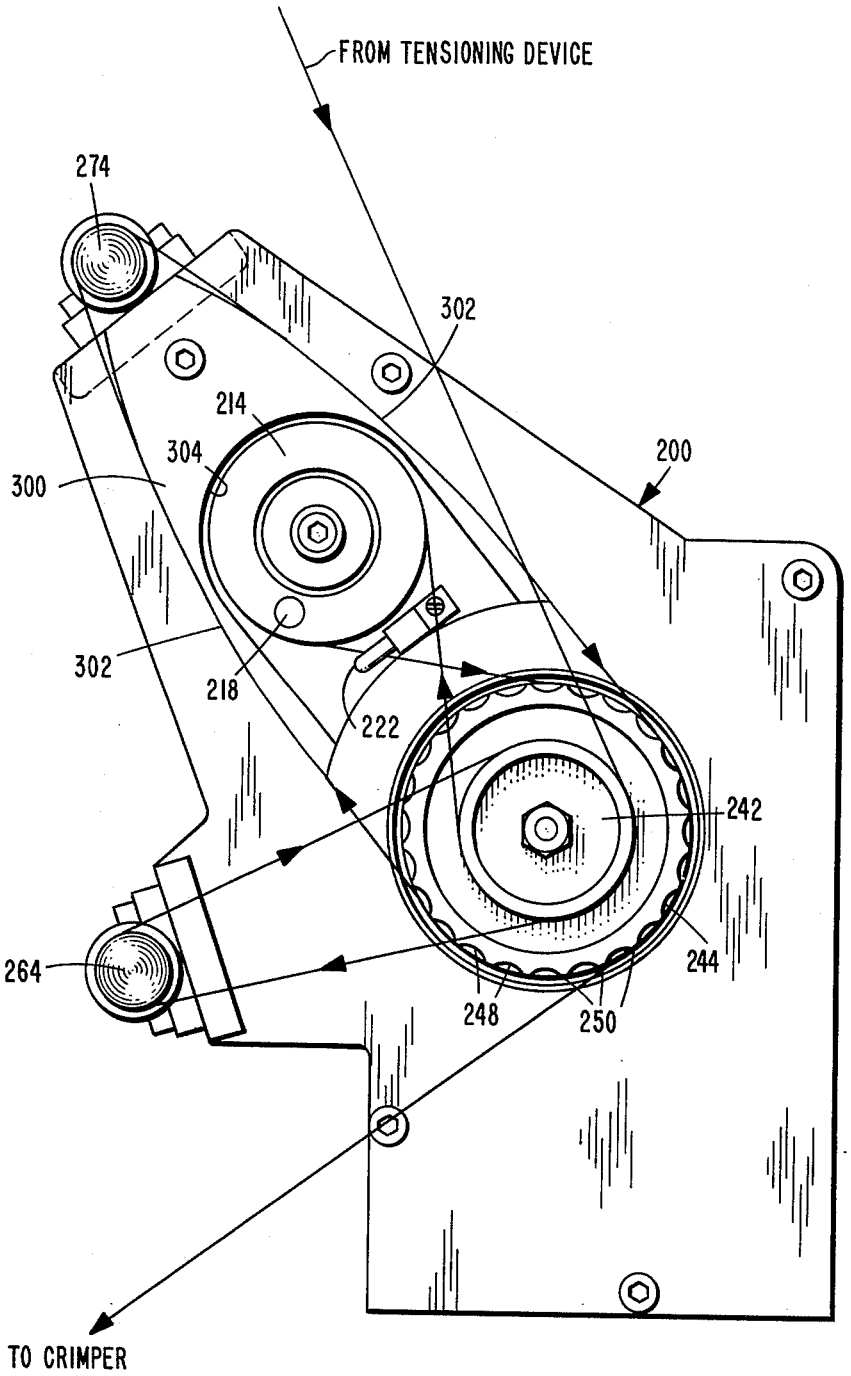
FIG. 4 is an elevational view of a second embodiment of the invention, showing a front view of the yarn draw mechanism and integral yarn preheater.

A second embodiment of the inventive apparatus is shown in FIG. 4. The operation, advantages, and features of the embodiment are the same as the first embodiment, except that the placement of the preheater is different. The second embodiment has a frame 200. A draw pin 214 is mounted on frame 200. A heater 218 is provided to heat draw pin 214 and a yarn guide 222. The draw rolls comprise a first draw roll 242 and a second draw roll 244, which are exactly like those of the first embodiment. Second draw roll 244 has flutes 248, which separate the peripheral surface into yarn contacting section 250. A first separator roll 264 is provided for use in conjunction with first draw roll 242, and a second separator roll 274 is provided for second draw roll 244.

Mounted between second draw roll 244 and second separator roll 274 is a wedge-shaped yarn heater 300, which has a pair of curved side surfaces 302 and an inner surface 304 which defines a cavity surrounding draw pin 214. Side surfaces 302 contact and heat the yarn. A temperature sensor and control unit, not shown, senses the level of temperature at the heater and at the draw pin. One advantage of this heater placement over that of the first embodiment is that only one temperature sensor need be used, as opposed to two in the first embodiment. Of course, this has the advantage of less cost and less complication of components. Advantageously, draw pin 214 and heater 30 are integral, that is, made from a single piece of stock. The draw pin and the heater are heated to the same temperature. In this embodiment, the yarn heater is farther from the crimping chamber than in the first embodiment, and therefore the less heat lost by the yarn in the draw zone, the better. Thus, the particular design of the second draw roll set forth herein is quite advantageous, because it reduces to the minimum the heat lost from the yarn to the second draw roll. Also, this particular draw roll construction insures that the draw roll itself does not get too hot. For example, in the inventive apparatus, the second draw roll operates within a high temperature range of 35–45 degrees Centigrade, while a conventional second draw roll under these circumstances could rise to 115° Centigrade. The heat absorbed by the draw roll is that which is removed from the yarn, thus lowering the temperature of the yarn. As stated above, the yarn must be crimped at a particular temperature, so this lost heat must be added back into the yarn, thus reducing the overall efficiency of the system.

The operation of the second embodiment is quite similar to the first. The yarn is initially received from a tension gate, and passes to first draw roll 242. It is wrapped around first draw roll 242 and its separator roll 264 about six times, and then makes a single pass around draw pin 214. Drawing is accomplished while the yarn is on draw pin 214. The drawing tension is provided by passing the yarn around second draw roll 252 and its separator roll 274. Again, about six passes are made. During the passes between second draw roll 244 and separator roll 274, the yarn contacts heating surfaces 302 of heater 300, and is heated thereby. The heated yarn then leaves second draw roll 244 and proceeds to the crimper traverse mechanism.

As stated above, there are a number of factors that effect the tension present in the yarn between the final draw roll and the crimper feed rolls. There is the inherent reduction in length of the yarn caused by the relaxing of tension, and there is the effect of cooling the yarn. The other factor is, of course, the relative linear speeds of final draw roll and feed rolls. In this regard, an interesting discovery has been made. It has been found that the peripheral surface speed of the feed rolls must be greater than the peripheral surface speed of the final draw roll in order to move the yarn into the crimper at the same rate as it was moved by the final draw roll. This surprising happening appears to be caused by the fact that while the yarn is wrapped around and flattened upon the final draw roll, and thus moves at the same linear speed as the periphery of the final draw roll, it is pinched between the pair of feed rolls, but not flattened thereby. The momentary squeezing together of the yarn in the bite of the feed rolls causes a momentary increase in the length of the yarn in the bite which, in essence, is a loss of efficiency in moving the yarn, which manifests itself in a slight decrease in linear movement of the yarn adjacent to the bite, relative to the peripheral surface speed of the feed rolls. Therefore, the crimper feed rolls must move at a slightly greater linear rate than the final draw roll, to move the same amount of yarn.

While variations and modifications of the above described embodiments of the invention may become apparent to one skilled in the art, it should be realized that the breadth of the invention is not so limited, but is defined only by the scope of the appended claims.

We claim:

1. A yarn treating apparatus comprising:

a yarn crimper having a pair of feed rolls for moving yarn into a crimping chamber, feed roll drive means for rotating said feed rolls at a constant rate of rotation to move yarn into said crimping chamber at a fixed linear rate, first and second draw rolls for drawing the yarn positioned in advance of said feed rolls and spaced therefrom along the yarn path, means for rotating said first draw roll at a first peripheral speed, means for rotating said second draw roll at a second peripheral speed greater than said first peripheral speed, said yarn passing first around said first draw roll and then around said second draw roll whereby said yarn is drawn, said means for rotating said second draw roll comprising a variable speed drive to adjust the peripheral speed of said second draw roll to maintain the yarn between said second draw roll and said feed rolls at a constant predetermined tension, and means for heating said yarn at a point between said first and second draw rolls.

2. The apparatus of claim 1 wherein said first and second draw rolls are attached together and rotate about a common axis, wherein the diameter of said second draw roll is greater than the diameter of said first draw roll, wherein said variable speed drive rotates both said first and said second drive roll, and further comprising a draw pin radially spaced from said common axis, said yarn passing first around said first draw roll, then around said draw pin, and then around said second draw roll.

3. The apparatus of claim 1 wherein said second draw roll comprises a second peripheral surface having a plurality of circumferentially spaced flutes, said yarn contacting said second peripheral surface only between said flutes, thereby minimizing the transfer of heat from said yarn to said second draw roll.

4. The apparatus of claim 3 wherein said second draw roll further comprises a heat insulative coating on said second peripheral surface.

5. The apparatus of claim 3 wherein said flutes are of concave arcuate configuration in cross-section.

* * * * *